US005085427A

United States Patent [19]

Finn

[11] Patent Number: 5,085,427

[45] Date of Patent: Feb. 4, 1992

[54] PORTABLE MULTI-PURPOSE RACK FOR USE ON EXERCISE EQUIPMENT

[75] Inventor: Bruce Finn, Hudson, N.Y.

[73] Assignee: Finnish Line Products Incorporated, Hudson, N.Y.

[21] Appl. No.: 496,865

[22] Filed: Mar. 20, 1990

[51] Int. Cl.[5] ..... A63B 22/02; A47B 19/00

[52] U.S. Cl. ..... 272/69; 272/93; 248/441.1

[58] Field of Search ..... 272/69, 93; 248/441.1, 248/444.1, 445, 447.1, 450

[56] References Cited

U.S. PATENT DOCUMENTS 3,809,352 5/1974 Mathias ..... 248/444.1

4,073,460 2/1978 Dale ..... 248/441.1

FOREIGN PATENT DOCUMENTS 1478012 6/1977 United Kingdom ..... 248/444.1

*Primary Examiner*—Stephen R. Crow

*Attorney, Agent, or Firm*—Heslin & Rothenberg

[57] ABSTRACT

A portable multi-purpose rack for use on exercise equipment is disclosed, having a transparent substantially planer surface with flanges extending at opposite angles from each end. The first flange is mounted upon the upper edge of the digital display of a piece of exercise equipment and the planer surface placed directly upon the digital display. The bottom flange forms a lip which holds a book or other object thereon so that the user of the exercise equipment may place an object or book directly upon the portable multi-purpose rack without obstructing the view of the display screen.

7 Claims, 3 Drawing Sheets

PORTABLE MULTI-PURPOSE RACK FOR USE ON EXERCISE EQUIPMENT

BACKGROUND OF THE INVENTION

1. Field of the Invention

This invention relates to the field of exercise equipment and, more particularly, to a portable multi-purpose rack system for use thereon.

2. Description of the Prior Part

Today's exercise equipment is much more advanced than the equipment used in the past. For example, many exercise machines contain display screens which display a certain program and various functions of both the machine and the person using the machine. These displays are often digital or three dimensional type screens and indicate the amount of calories burned, the time spent on the machine, the speed and/or power used within the machine as well as giving a profile of the level of difficulty of the workout. As a result it is necessary for the user of these modern exercise machines to view the display screen so they can personally self-monitor their workout and examine the functions being performed and their performance as well.

However, it is not necessary for the user of the machine to continuously watch the display. Typically, the display is viewed by the user periodically so as to make sure that the user's performance has not declined or the time for using the machine has finished. These displays are typically mounted on a flat surface which have various digital and LED readouts. The surface is often mounted on an incline to give the user a proper line of vision to the display readout.

In order to make the exercise being performed, either feel shorter or be more productive, users of exercise equipment often read books or review materials, listen to music, conduct work and even write while exercising on these machines. Therefore, the users of exercise equipment often hold a book, paper or pad, or if the user wants to listen to music, a portable compact disc player or walkman type miniature radio or cassette player. Sometimes, however, users place their books, magazines or papers on the display screen and hold it in position with their hands. However, most modern pieces of exercise equipment have handles for the user to grip in order to stabilize the users position. If the user is to hold a book or radio (for example) with one hand then he or she can only grip one of the handles on the exercise machine. A problem with users of the equipment reading books or listening to music is that the user still cannot grip the handles with both hands and read at the same time. The result being that the user of the exercise machine cannot properly balance themselves while reading a book or magazine. The present invention, however, enables the user to read while keeping both hands on the exercise machine thereby maintaining stability and balance.

There exist devices which may hold books or other materials on certain types of exercise equipment. However, these devices are often cumbersome, are not portable and must be fixed to the exercise equipment by either bolting or clamping on the equipment. Furthermore, people often take racks which are used on stationary bicycles and gerryrig them so they may be used on modern types of exercise equipment.

On the contrary, the portable multi-purpose rack for use with exercise equipment according to this invention, creates a novel system for reading, while using modern advanced exercise equipment, or writing or listening to music while offering the user a sufficient place to put it's cassette player, radio, walkman or portable CD player.

SUMMARY OF THE INVENTION

Accordingly, it is a primary object of this invention to provide a rack which is usable on modern exercise equipment with a display screen, which may be used for a variety of different purposes.

A further object of this invention is to provide a rack usable with modern exercise equipment that is portable and may be easily carried and transferred from one piece of exercise equipment to another. Such a portable rack should be easily mountable without the use of clamps, bolts or other types of fasteners. Additionally, it is an object of this invention to provide a multi-purpose rack which is substantially transparent so that it does not obstruct the view of the display screen so that the user of the exercise equipment may continue to monitor his workout through a substantially unimpaired reading of the digital display.

Also, it is an object of this invention to provide a multi-purpose rack which allows the user to place both hands if necessary or required on the exercise equipment while reading or listening to music. Furthermore, an object of this invention is to provide a multi-purpose rack which does not take up any more room than the original piece of exercise equipment so as to minimize the area needed to place a particular piece of exercise equipment.

Another object of this invention is to provide a multi-purpose rack which mounts on top of the display screen and thereby protects the equipment and the display screen from dust, spilled water, sweat or any other elements or causes which may damage the display screen. Furthermore, the multi-purpose rack accorded to the present invention should be non-porous so that it may be easily sanitized and cleaned so as to provide a convenient piece of equipment which needs no special servicing or maintenance. Also, it is an object of this invention to provide a rack which has no sharp edges or points which may tend to injure a person. Finally, it is the object of the present invention to provide a multi-purpose rack which is substantially universal so that it may fit many different types of modern exercise equipment which contain display screens that are mounted on an inclined or slightly inclined plane, relative to a vertical axis. The owner and/or user of the equipment may use the present invention on many types of similar equipment without the need for another multi-purpose rack.

A portable multi-purpose rack for use on exercise equipment has a substantially transparent flat surface, a first flange extending at an angle from one end of the transparent flat surface and a second flange extending at an angle from the opposite end of of the transparent flat surface. The first flange can be placed over the upper edge of a display screen of a piece of exercise equipment so the flat surface can rest directly upon the display screen. A book or other article can be placed on the flat surface and rest upon the second flange to enable the user of the exercise equipment to place the article on the rack without substantially obstructing the view of the display screen.

The portable multi-purpose rack may contain several advantageous features. For example, the rack is constructed from a single piece of clear plastic so there are no moveable parts, joints, seams or the like. This results in a rack which is lightweight, durable, fairly rigid, highly resistant to stress and shock and also slightly flexible so that it may bend slightly if necessary. The rack will, therefore, not break when dropped to the floor and also withstand other moderate abuse.

Another desirable feature of the invention is that the first and second flanges can be of equal length and positioned at the same degree of angle relative to the substantially transparent flat surface. Because of this feature the rack can be inverted when used so that the first flange (which normally hooks onto the top edge of the display screen) can perform the same function of the second flange (which normally supports the article placed on the rack) and vice-versa.

Another feature of the invention is that the length and relative angle positions of the flanges enables the invention to be used on several different models of exercise equipment with different types of display screens.

Also, another feature of the invention is that the edges of the first and second flanges are rounded so that there are no sharp corners. This feature also helps prevent the clear plastic from cracking when subjected to shock of being dropped.

DETAILED DESCRIPTION OF THE PREFERRED EMBODIMENT

Figure 1:
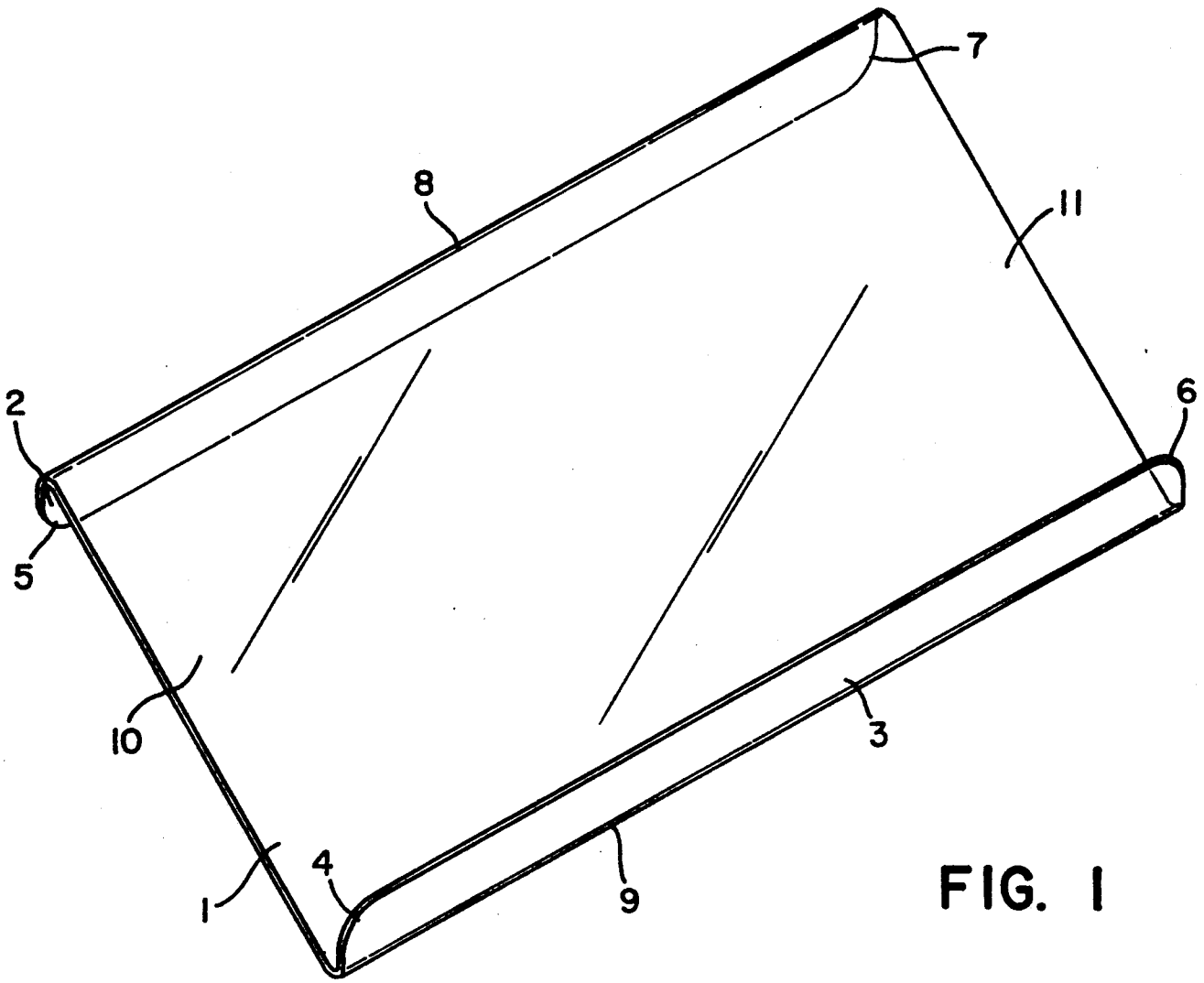
FIG. 1 is an isometric view of the portable multi-purpose rack usable with modern exercise equipment.
Figure 2:
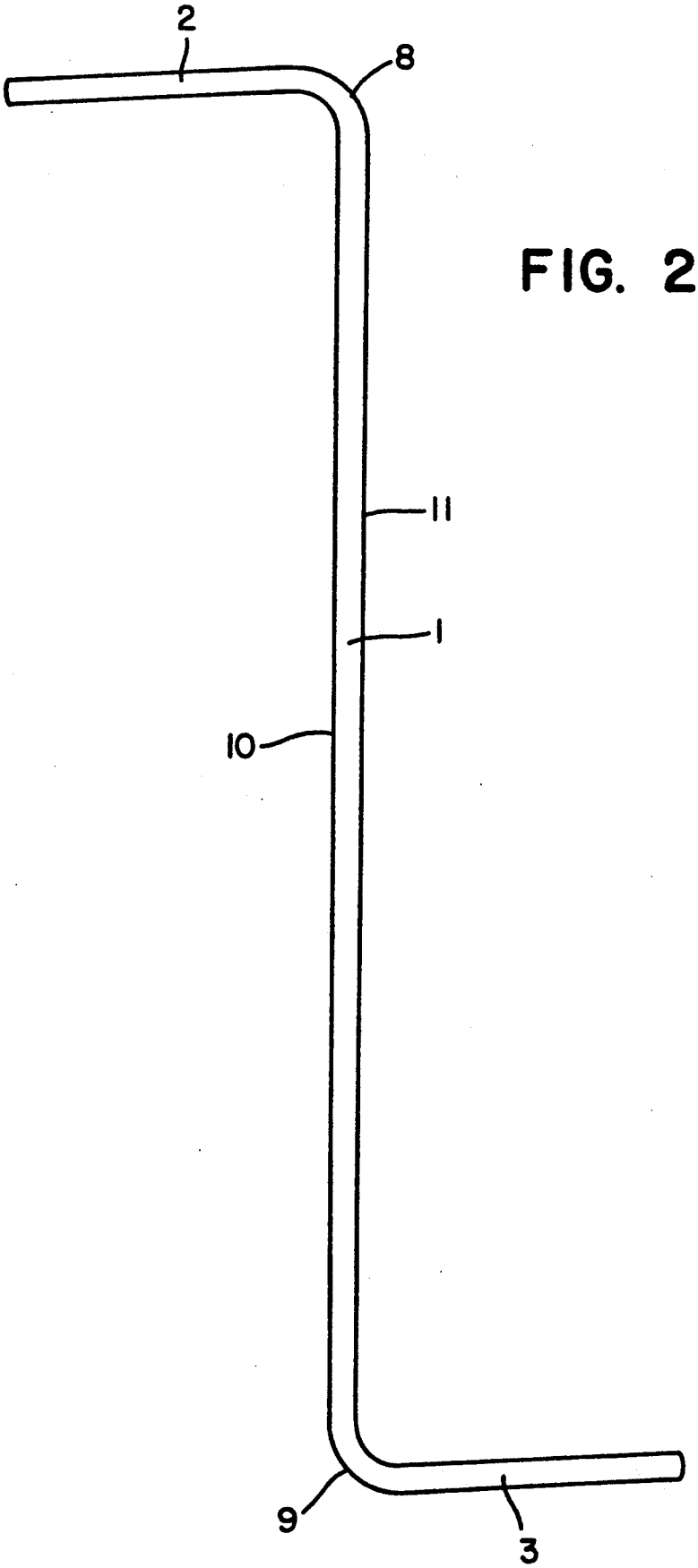
FIG. 2 is a side view of the multi-purpose rack shown in FIG. 1.

Referring now to the drawings, wherein like reference characters refer to like and corresponding parts throughout the several views, FIGS. 1 and 2 illustrate the portable multi-purpose rack usable with modern exercise equipment. The rack itself should be made of a clear plastic type of material such as plexi-glass or Lexan, the preferred materials for use in this invention. These materials allow the portable rack to be mounted on the digital display and still allow the user to view the digital display functions through the rack. For this purpose, a substantially clear transparent material will suffice. Plastic such as Lexan or plexi-glass is preferred over other similar materials because of its shock retention and absorbing properties, flexibility and its greater resistance to impact, pressures and stresses. Glass, however, because of its brittle structure, is more prone to breaking and although it may be used in the present invention, it is not preferred.

As shown in FIGS. 1 and 2, the portable multi-purpose rack contains a substantially transparent, substantially flat planer surface 1 having a first flange 2 extending at an angle, at one end thereof, and a second flange 3 extending on the opposite end thereof towards the opposite direction as the first flange. As shown in FIG. 2, a side view of the present invention indicates the proper configuration of the end flanges 2, 3 with respect to the flat planer surface 1. The resulting configuration of the rack is similar to a Z-shape when viewed from a side image such as that of FIG. 2.

Figure 3:
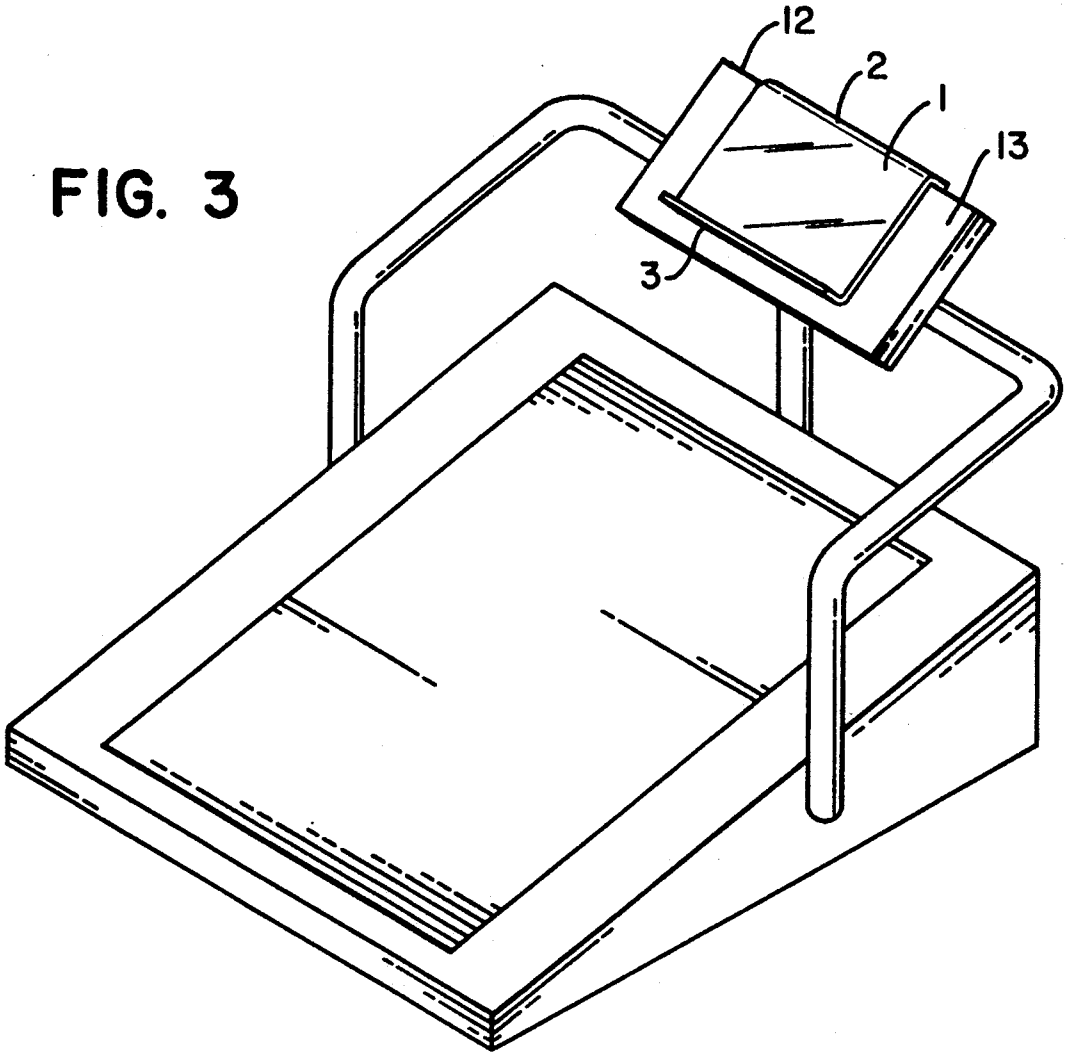
FIG. 3 is an isometric view of the portable multi-purpose rack shown in FIGS. 1 and 2 while mounted on a display screen of a piece of modern exercise equipment.

As shown in FIG. 3, the first flange functions to hook on the upper edge 12 of the digital display screen 13 of a particular piece of exercise equipment. The second flange 3 functions as a lip or ledge upon which various items such as books, papers, magazines, portable radios, walkmans and CD players may be placed.

The portable multi-purpose rack is mounted by placing the underside 10 of the flat planer surface 1 directly on top of the digital-type display screen 13 such that the first flange 2 hooks or rests against the top edge 12 of the display screen 13. This prevents the entire rack from sliding downward off the display screen and enables the rack to rest on the display screen and remain stable even if the display screen is at a substantially vertical incline.

The second flange 3 acts as a lip or ledge which prevents items mounted on the rack from sliding off. For example, as shown in FIG. 3, when the portable rack is mounted on the display screen, a book or radio can be placed on the flat planer surface 1 such that the bottom of the book or radio rests upon the second flange 2 and the back of the book or radio rests directly on the planer surface 1 of the portable rack. The configuration of the portable multi-purpose rack enables the particular object, whether or not a radio or book, to be placed thereon and remain squarely on the rack without risk of the object sliding or falling off.

As shown in FIG. 2, preferably the first and second flanges 2, 3 should protrude at an angle of about eighty-seven degrees from the flat planer surface 1. This particular dimension is preferred because it enables the rack to hold objects and remain on the digital-type display without sliding off. Although, an eighty-seven degree angle is preferred, the rack will remain on most displays screens if the angle between the first flange and the planer surface is not greater than ninety-five degrees. Of course, the dimension of this angle sufficient to allow the rack to remain on the display screen depends upon the incline of the display screen and the particular geometry of the upper edge 12 of the display screen. Typically, the greater the incline of the display screen, the sharper the angle between the flat surface 1 and first flange 2 must be for the rack to remain stable. Different types of exercise machines having different positions and shapes may require the rack to have different angles between the flat surface 1 and first flange 2. Preferably however, an angle between the first flange and the planer surface of not be less than seventy degrees should enable the portable multi-purpose rack to be used on most currently available types of equipment. Moreover, it has been found that an angle of up to ninty-five degrees has allowed the rack to remain on the display screen of the Aerobicycle exercise machine. It is believed, that as technology advances the display screen of most exercise equipment will become thinner and the angle between the first flange 2 and the flat surface can be made sharper or more acute.

Although the aforementioned dimensions represent the preferred maximum and minimum angle of the first flange 2, the preferred angles may vary when the invention is used on different models of exercise equipment. However, making the first flange 2 eighty-seven degrees from the planer surface will enable the user to place the invention on a multitude of models and types of exercise equipment.

The relative angle between the second flange 3 and the flat planer surface 1 should be approximately the same dimension as the relative angle between the first flange 2 and the flat planer surface 1. This enables the rack to be used in a manner which allows either the first flange 2 or the second flange 3 to be hooked onto the top edge 12 of the digital display screen 13. The remaining flange is then used to rest the particular item placed upon the rack. The result being, there is no actual top or bottom to the rack. The rack can be inverted and the first flange 2 can function as the second flange 3 and the second flange 3 function as the first flange 2, so that either the underside 10 or topside 11 is in contact with the display screen or vice-versa. Although having equal angles is a convenient feature which prevents the user from trying to figure out which flange 2, 3 is the first flange 2 and which flange is the second flange 3, it is not critical or necessary for the invention that the angles be identical. So long as the angles are of a dimension which prevents the rack from sliding off the digital display while holding an object then the portable rack will perform its intended function while the user performs his or her exercise routine on the exercise equipment.

Since a primary feature of the invention is that it must be substantially transparent, so that the user's view of the display screen is not impaired, a clear plastic such as plexi-glass or Lexan is the preferred material for fabrication of the rack according to the present invention. Either material because of its transparency, high resistance to stresses, shock, slight flexibility and strength as well as propensity for ease of manufacturing is sufficient.

Preferably, the thickness of the clear plastic including the planer surface 1 and flanges 2, 3 should not be less than one-eighth of an inch. A thinner dimension creates a propensity for the corner areas 8, 9 between the flat planer surface and the first flange 2 or second flange 3 to crack if the portable multi-purpose rack is subjected to shock or impact (such as being dropped on the floor). To prevent such a problem it is suggested that the thickness of the plastic for which the rack is fabricated is not less than one-eighth of an inch. Also, the thickness of the clear plastic is preferred to be one-eighth of an inch because the rack is strong enough yet lightweight. Moreover, one-eighth of an inch is standard size for sheet plastic making the invention easier to manufacture. However, sheet plastic also comes in other standard thicknesses such as one-quarter of an inch which may also be preferred for manufacturing purposes. The rack could conceivably be made thinner than one-eighth of an inch. However, the rack cannot be so flexible that it cannot support the weight of an object that it supports or resist minor shocks or impacts.

To prevent the rack from cracking when it is accidentally dropped by the user, the corners 4, 5, 6, 7 of the flanges 2, 3 should be rounded so that there is not a point or sharp edge on either corner. The rounded corners 4, 5, 6, 7 allow for the corner edges 8, 9 between the flanges 2, 3 and the planer surface 1 to be less prone to cracking because less of a stress is transmitted therethrough when a flange and/or its rounded corner impacts a surface. This occurs because there is less bending of the flange with the rounded corner when compared to a flange with a non-rounded corner.

The degree in which the corners 4, 5, 6, 7 should be rounded may vary. However, the greater the degree of rounding of the corners the greater the structural integrity of the invention as a whole. It is preferred that the outer edge of the flange be completely rounded such that the arc of the rounded corner 5 corresponds to approximately ninety degrees or a quarter of a circle.

The corner edges 8, 9 between the flanges and the planer surface are rounded as opposed to cornered. This also helps prevent the rack from cracking upon impact with a surface because rounded corner edges 8, 9 are capable of withstanding higher stresses than traditional corners.

Rounded corner edges 8, 9 also allow the portable multi-purpose rack to be used with a variety of different pieces of exercise equipment each with different size and/or positioned display screens. The present invention can be used with many different types of exercise equipment (stationary bicycles, treadmills and stair climbing simulators) including Lifecycle, Lifestep 1000, Alpine Sports Tru-climb 300 and 450 models, II Step, some Trotter Treadmills, some Clinton models and Stairmaster's PT4000 and Gauntlet machines. It is also believed that the invention can be used on other types of machines not listed herein.

The particular embodiment shown in FIGS. 1 and 2, because of the rounded corner edges 8, 9, can be used with equipment containing display screens having rounded top edges such as the Alpine Sports Tru-climb 300 and 450 models. Moreover, certain models of exercise equipment, for example the Stairmaster PT4000, contain display screens which are digital-type and have airflow passages in the top edges which allow air into the display to cool the electronic circuitry therein. The first flange 2 of the portable multi-purpose rack should not cover the airflow passages. The flange should not exceed a length that will cover the airflow passage and prevent the electronic circuitry from being properly cooled. If the flange covers the airflow passages the digital display may become damaged from excessive heat.

Because the object placed on the rack may partially obstruct the view of the display screen, the flat surface 1 and second flange 3 of the rack should be wide enough for the object to be slid across the flat surface 1 and second flange 3. This will enble the user to view a particular portion of the display screen that is covered by the object to merely slide the object over. Obviously, the exact height and width of the flat surface 1 and flanges 2, 3 depend upon the size of the display screen on the piece of exercise equipment.

Although other dimensions will suffice, the preferred dimensions for the invention are: one eighth inch thickness for the flanges and flat planer surface, a planer surface height of approximately eight inches and width of thirteen and one half inches; the flanges should extend two inches and eighty-seven degrees from the flat planer surface and be the same width, thirteen and one half inches, as the flat planer surface. These dimensions enable the invention to be used on all of the aforementioned exercise equipment as well as, it is believed, various other models upon which the invention has not yet been tested as well as similar equipment yet to be developed.

There are various techniques which may be used to manufacture the portable multi-purpose rack. A simple heat molding process done by hand with a manual brake in which plexiglass may be preferred. A vacuum heat molding process may also be used to manufacture the portable rack. Also, hot injection molding process may be used to manufacture the rack out of plexi-glass, Lexan or other similar type plastics. Cold processing techniques may also be used to manufacture the rack; it is believed that Lexan or similar type plastics may be more easily shaped in this method compared to plexiglass.

If the user of an exercise machine chooses to read a thick book or a magazine a rubberband may be used to help hold the pages of the book open. For instance, if an open book is placed upon the second flange 3 while the rack is placed on the piece of exercise equipment (by hooking the first flange to the upper edge of the display screen), a rubberband can be placed around the open book and the flat planer surface 1. The rubberband contacts the underside 10 of the flat planer surface 1 and the pages of the open book to hold the book open. Although, a rubberband used in such a manner may be helpful, it is not necessary to the invention nor is it necessary when using the invention with relatively thin magazines, manuscripts or books.

While the invention has been illustrated and described as embodied in the portable multi-purpose rack for use on exercise equipment, it is not intended to be limited to the details shown, since various modifications and structural changes may be made without departing from the spirit of the present invention.

I claim:

1. A system for supporting articles including reading materials or the like on exercise equipment comprising:

a piece of exercise equipment having a display screen thereon;

a portable rack mounted on the display screen, said rack comprising:

a transparent planar surface having an upper end, a lower end, an underside and a topside;

a first flange protruding from the upper end of the planar surface in a first direction, said first flange and said upper end being connected by a first corner area;

a second flange protruding from the lower end of the planar surface in a second direction, said second flange and said lower end being connected by a second corner area wherein the underside of the transparent planar surface between the second corner area and the first corner area is a flat surface;

the first flange being mounted over the upper edge of the display screen of the piece of exercise equipment and the underside of the transparent planar surface contacting the surface area of the display screen, and the second flange and topside of the planar surface are capable of supporting a book or similar article thereon.

2. A system for supporting articles on exercise equipment according to claim 11 wherein the flat surface and first and second flanges are made of a single piece of substantially transparent plastic.

3. A system for supporting articles on exercise equipment according to claim 2 wherein the first flange extends at an angle of between seventy degrees and ninety-five degrees from the substantially transparent flat planer surface.

4. A system for supporting articles on exercise equipment according to claim 3 wherein the corners of the first flange and second flange are rounded.

5. A system for supporting articles on exercise equipment according to claim 4 wherein the first flange extends at an angle of eighty-seven degrees from the flat planar surface.

6. A system for supporting articles on exercise equipment according to claim 5 wherein both the first flange and second flange extend at an angle of eighty-seven degrees from the flat planer surface.

7. A system for supporting articles on exercise equipment according to claim 2 wherein the single piece of transparent plastic is either one of Plexi-glass or Lexan.

* * * * *

UNITED STATES PATENT AND TRADEMARK OFFICE

CERTIFICATE OF CORRECTION

PATENT NO. : 5,085,427

DATED : February 4, 1992

INVENTOR(S) : Bruce Finn

It is certified that error appears in the above-identified patent and that said Letters Patent is hereby corrected as shown below:

Column 8:

Claim 2, line 12 "11" should be --1--.

Claim 7, line 33 "or" should be --and--.

Signed and Sealed this

Fourth Day of May, 1993

Michael K. Kirk

MICHAEL K. KIRK

*Acting Commissioner of Patents and Trademarks*

*Attest:*

*Attesting Officer*